United States Patent [19]
Kranich et al.
[11] 4,175,807
[45] Nov. 27, 1979

[54] MODULAR CONSTRUCTIONAL UNITS FOR A COMBINED STORAGE BIN AND DISPLAY ASSEMBLY

[75] Inventors: Joel H. Kranich, 1 Parkton Pl., Pittsburgh, Pa. 15232; Robert A. Adam; Charles L. Culbertson, both of Pittsburgh, Pa.

[73] Assignee: Joel H. Kranich, Pittsburgh, Pa.

[21] Appl. No.: 961,350

[22] Filed: Nov. 16, 1978

[51] Int. Cl.[2] ..... A47B 53/00; A47F 3/00; A47B 47/00

[52] U.S. Cl. ..... 312/118; 312/198; 312/234; 211/194; 206/44.11

[58] Field of Search ..... 312/117, 118, 111, 234, 312/234.1, 198, 278, 200, 201, 262; 206/44.11, 45; 108/60; 211/194

[56] References Cited

U.S. PATENT DOCUMENTS

| | | | |
|---|---|---|---|
| 264,750 | 9/1882 | Potts | 312/200 |
| 714,427 | 11/1902 | Winters | 312/118 |
| 1,325,239 | 12/1919 | Flannery, Jr. | 312/117 |
| 1,563,148 | 11/1925 | Bartol, Jr. et al. | 206/44.11 |
| 1,852,471 | 4/1932 | Nelson | 108/60 |
| 2,547,368 | 4/1951 | Booth | 312/198 |
| 3,567,302 | 3/1971 | Carlson | 312/198 |
| 3,737,046 | 6/1973 | Jeter | 108/60 |
| 3,986,756 | 10/1976 | Kranich | 312/117 |
| 4,080,022 | 3/1978 | Canfield et al. | 312/198 |

*Primary Examiner*—Victor N. Sakran
*Attorney, Agent, or Firm*—Thomas H. Murray; Clifford A. Poff

[57] ABSTRACT

Modular constructional units are used to form a combined storage bin and display assembly for rolls of decorative paper such as wallpaper. The modular constructional units are vertically stacked and horizontally adjoined by interlocking surfaces while the units extend along an essentially straight-line path and form storage bins and displays disposed at an angle with respect to the straight-line path. Each constructional unit includes three mutually-adjoined side walls to a square prism which defines the shape of the bin. These side walls define a horizontal bin floor, a vertical bin rear end wall and a vertical longitudinal bin side wall. An outwardly-facing vertical display wall is projected from the bin side wall beyond the forward edge of the bin floor. The display wall and the bin side wall form a side wall for a horizontally-adjacent storage bin. The display wall includes a horizontal rib and a recess with upper and lower support surfaces to engage a display panel at its opposite sides in a vertical stack of the constructional units. An end strip is attached to the outer edge of the display panel and the display wall.

17 Claims, 7 Drawing Figures

MODULAR CONSTRUCTIONAL UNITS FOR A COMBINED STORAGE BIN AND DISPLAY ASSEMBLY

BACKGROUND OF THE INVENTION

This invention relates to an improved construction and arrangement of parts to provide modular constructional units to form a combined storage area and display assembly for rolls of decorative paper and the like; and more particularly, the present invention relates to such modular constructional units uniquely constructed for vertical stacking and horizontal adjoining to extend along an essentially straight-line path while forming storage bins and displays at an angle with respect to the straight-line path.

The customary practice of thumbing through sample books to select an appealing decorative paper such as wallpaper has been replaced to a large extent by more recent advancements to the merchandizing of wallpaper on a serve-yourself-basis. The use of sample books demands the time and expense of a salesperson to take an identifying number from a sample of wallpaper in the display book and locate the corresponding roll of wallpaper from inventory. The more recent serve-yourself-concept is to permit the customer to browse around the store and pick rolls of wallpaper or other decorative material directly from storage bins.

A particularly useful solution to the problem of displaying samples of various wallpaper within the bins is disclosed in U.S. Pat. No. 3,986,756. In this patent, there is disclosed an angular arrangement between a straight-line path and the storage bins with a display area adjacent each bin. The storage bins and display areas are formed by spaced, vertically-extending side partitions disposed at an angle with respect to the straight-line path along which a platform extends for supporting the partitions. Bins are formed by shelves that span the space between each adjacent pair of parallel partitions. The forward and rear edges of the shelves are perpendicular to two bounding partitions but the forward edge of each shelf does not extend beyond the forward edge of one of the two bounding partitions. This arrangement of partitions and shelves has the distinct advantage of maximizing the use of available floor space to provide both bins and display areas for a sample of wallpaper directly adjacent the storage bin.

However, the construction of parts necessary to form the storage bins and display areas is a costly and time-consuming operation requiring the use of skilled labor. The vertical partitioned walls for a stack of bins at each side thereof are an integral part of the assembly which are not easily dismantled for rearrangement or reconstruction at other locations as may be desired or necessary from time-to-time. These and other disadvantages and shortcomings are overcome by the modular constructional units of the present invention.

SUMMARY OF THE INVENTION

It is an object of the present invention to provide a combined storage bin and display assembly for decorative paper and the like wherein the assembly is comprised of vertically-stacked and horizontally-adjoined modular constructional units that are constructed for arrangement along an essentially straight-line path while forming storage bins and displays disposed at an angle with respect to the straight-line path.

It is a further object of the present invention to provide modular constructional units for vertical stacking and horizontal adjoining to form a combined storage bin and display assembly wherein the constructional units each takes the form of a unitary member that is readily formable from molded plastic material and readily assembled and disassembled without the need for fasteners or skilled labor.

According to one aspect of the present invention, there is provided a combined storage bin and display assembly for decorative paper and the like wherein the assembly is comprised of vertically-stacked and horizontally-adjoined modular constructional units each essentially including a horizontal wall section to define in a vertical stack of constructional units at least a bin ceiling or a bin floor, a side wall section extending vertically from the horizontal wall section along two intersecting peripheral edge portions thereof, the side wall section defining a rear end wall and a longitudinal bin side wall, the longitudinal bin side wall having an outwardly-facing vertical display area extended beyond the forward edge of the horizontal wall section, the horizontal wall section and the side wall section each having support surfaces to interlock for either vertical stacking or horizontal adjoining of modular constructional units.

In another aspect of the present invention, the aforesaid combined storage bin and display assembly is defined wherein each of the storage bins has a shape of a square prism and the modular constructional units essentially include three mutually-adjoined bin side walls comprised of a horizontal side defining a bin floor in a vertical stack of constructional units, a first vertical side defining a bin rear end wall and a second vertical side defining a longitudinal bin side wall, the modular constructional units each further including an outwardly-facing vertical display wall projected from the longitudinal bin side wall beyond the forward edge of the bin floor, the longitudinal bin side wall and the display wall forming an entire side wall for a horizontally-adjacent storage bin, the bin floor and the longitudinal bin side wall having interlocking surfaces for vertical stacking and horizontal adjoining of modular constructional units at an angle along the straight-line path.

The modular constructional units of the present invention preferably include spaced-apart support posts extending vertically along the side wall sections thereof. The support posts have end portions adapted to interlock with recesses arranged at the outer periphery of the bin floor provided by a unit therebelow. A display panel is preferably employed to carry a sample of the decorative wallpaper for removable attachment to the display area of a modular constructional unit. For this purpose, fastener means are used to removably support the display panel on the display area. The display area has a horizontal support rib extending outwardly along a substantial portion of its length to provide a support surface for engagement by one of the opposite longitudinal sides of the vertically-spaced display panels. The spacing between the support ribs relative to the distance between the two opposed sides of the display panel is such that the display panel can be lifted from a lower support surface and then lowered to remove the display panel from the upper support rib. In the modular constructional units, the display walls extend outwardly from the bin floors by an equal distance so that the outer edges of the display panels are positioned on the straight-line path. The projected lengths of the display walls from the bin floors define the angular disposition of the constructional units while vertically stacked and horizontally adjoined.

These features and advantages of the present invention as well as others will be more fully understood when the following description is read in light of the accompanying drawings, in which.

Figure 1:
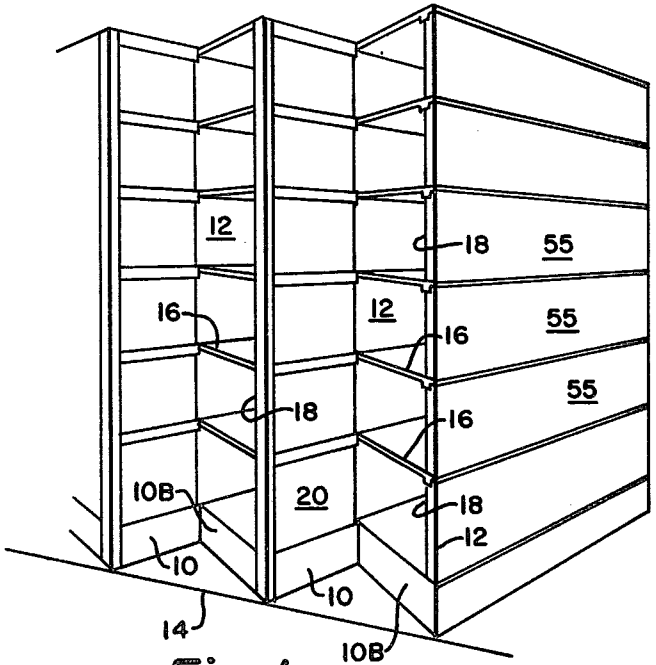
FIG. 1 is a perspective view of the combined storage bin and display assembly formed of constructional units accordance with the present invention.

With reference to FIG. 1, the modular constructional units of the present invention are employed to form a storage bin and display assembly that extends along a straight-line path in a store room. Typically, an aisle is formed by arranging two storage bins and display assemblies along spaced-apart and parallel straight-line paths along which customers may browse to select rolls of wallpaper or other material directly from the storage bins.

The modular constructional units forming the storage bin and display assembly of the present invention are constructed in a manner that enables the use of a portion of a modular constructional unit to form support bases for adjoined stacks of constructional units as described in greater detail hereinafter. In FIG. 1, reference numeral 10 identifies constructional units which have been modified to form raised support bases. The constructional units in their assembled form define spaced-apart, vertically-extending side partition walls 12 which are all disposed at an angle with respect to a straight-line path of travel identified in FIG. 1 by reference numeral 14. Spanning the space between each adjacent pair of parallel partition walls 12 are shelves 16 which form bins 18 for rolls of wallpaper or other decorative material. The angular arrangement of the storage bin and display assembly minimizes the amount of store floor space required. One side wall 12 for each stack of bins extends outwardly from the forward edge of the floor of the bin and defines, by its face surface, a display area 20 where a sample of wallpaper or other decorative material is displayed at the front of each of the bins. The modular constructional units 24 are shown in detail by FIGS. 2–7. The storage bins 18 each has the shape of a square prism. The constructional units 24 are essentially a unitary member with three mutually-adjoined walls, namely a horizontal wall 26 forming a bin floor 16, a vertical side wall forming a rear bin end wall 28 and a vertical side wall forming a longitudinal bin side wall 30. Depending upon the particular location of a constructional unit in a stack thereof, the horizontal wall 26 defines a bin ceiling or a bin floor or both.

Figure 7:
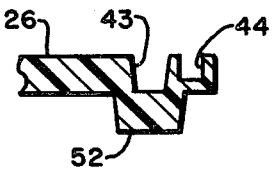
FIG. 7 is a sectional view taken along line VII—VII of FIG. 3.
Figure 5:
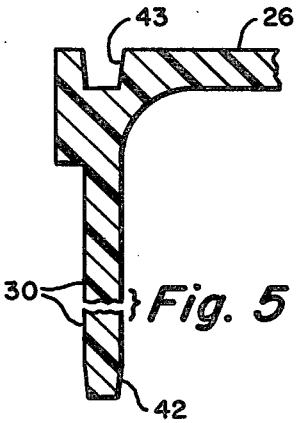
FIG. 5 is a sectional view taken along line V—V of FIG. 3.
Figure 4:
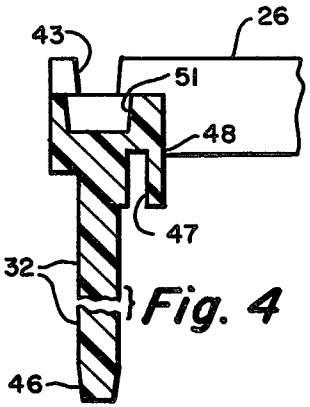
FIG. 4 is a sectional view taken along line IV—IV of FIG. 3.
Figure 6:
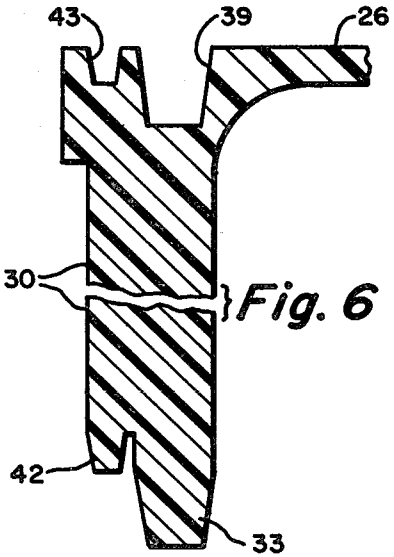
FIG. 6 is a sectional view taken along line VI—VI of FIG. 3.
Figure 2:
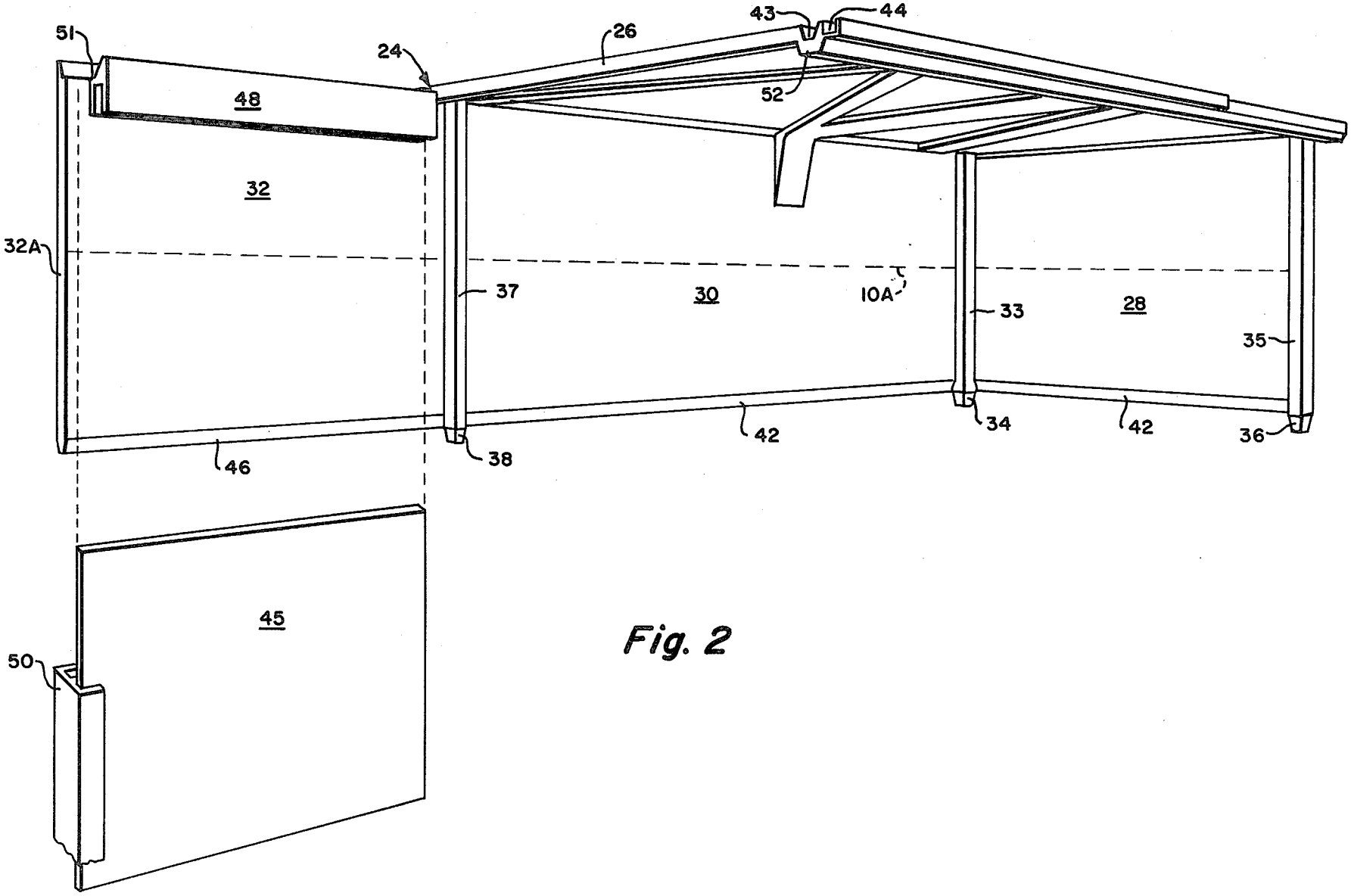
FIG. 2 is a perspective view of one constructional unit.
Figure 3:
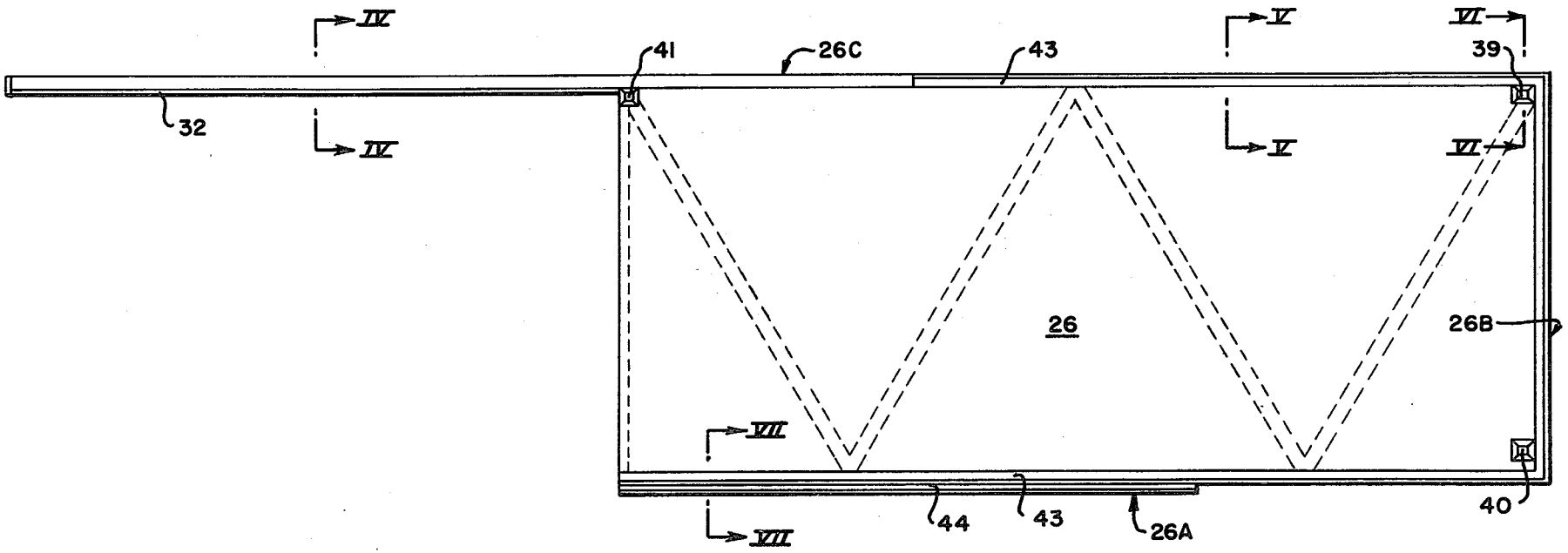
FIG. 3 is a plan view of the constructional unit shown in FIG. 2.

The display area 20 in the assembly of FIG. 1, is formed by an extended wall portion 32 of the longitudinal bin side wall 30 as shown in FIG. 2. The extended wall portion 32 forms a vertical display wall which projects outwardly beyond the forward terminal edge of the bin floor formed by the horizontal wall 26. When constructional units are horizontally adjoined, the longitudinal bin side wall 30 and the extended wall portion 32 form an entire side wall for a horizontally-adjacent storage bin which lies at the opposite side thereof from the display area 20. As is apparent from FIG. 2, walls 28 and 30 project downwardly from the horizontal wall 26. It is within the scope of the present invention to arrange walls 26, 28 and 30 such that walls 28 and 30 project upwardly from wall 26. At the junction between walls 28 and 30, a vertically-arranged post 33 extends from the horizontal wall 26 to the lower edge of walls 28 and 30 and below which the post 33 is provided with a tapered projection 34. A post 35 extends along the opposite vertical edge of wall 28 where a tapered projection 36 extends from its lower end. A third vertically-arranged post member 37 extends along the side wall portion 30 at the forward terminal edge of horizontal wall section 26. A tapered projection end 38 extends from the lower end of post 37. As shown in FIGS. 2, 3 and 6, the tapered projected portions 34, 36 and 38 of the post members are received in correspondingly-shaped socket recesses 39, 40 and 41 that extend below the top surface of the horizontal wall section 26 of a modular constructional unit that is disposed below the post members. The tapered projected portions and recesses into which they are received form one system of interlocking surfaces for the vertical stacking and horizontal adjoining of the modular constructional units. Another system of interlocking surfaces is formed by a tapered projecting rib 42 that extends from the lower edge of side wall 30 and from the lower edge of side wall 28. When the constructional units are stacked, the tapered projecting rib is received within a trough-like recess 43 formed in the top surface of the horizontal wall section 26. Recess 43 extends about three of the outer peripheral edges, namely side edge portions 26A, 26B and 26C (FIGS. 2, 5, 6 and 7). Moreover, as shown in FIGS. 2, 3 and 7 along side edge portion 26A, there is a second recess 44 into which the lower edge of a display panel 45 is received and supported. The horizontally-adjacent recess 43 receives the tapered rib 46 projecting from the lower edge of wall portion 32 in the stacked and adjoined arrangement of modular constructional units. In this regard, when stacking and adjoining modular units, the tapered rib 46 of a modular unit located above and to the right of a modular unit as one views FIG. 1 engages in recess 43 while the recess 44 provides a support trough into which the lower edge of a display panel 45 is supported. The upper edge of the display panel is retained within a recess 47 formed by a projecting rib section 48 as best shown in FIGS. 2, 3 and 4. Recess 47 is relatively deep, as compared to recess 44, so that a display panel 45 is easily removed by lifting the panel from recess 44 deeper into recess 47 and then moved outwardly and downwardly from recess 47. The recesses and projections used for interlocking support are the preferred manner by which constructional units are held together. However, adhesives may be used with or without interlocking surfaces. Thus, for example, adhesives are useful between face surfaces in mutual contact for support.

The forward edge 32A of each wall portion 32 extends to the straight-line path 14 and since wall portion 32 also forms a side wall for a horizontally-adjacent bin, the corner at the intersection of side edge portion 26A and front edge of a bin floor of an adjoining modular unit also extends to the straight-line path. Thus, it can be seen that the horizontally-extended length of wall portion 32 defines the angular relation of the display areas and bins with respect to the straight-line path. If desired, a side strip 50 having two channels therein is used to provide added support and retain the display panel 45 on the extended wall portion 32. One channel in strip 50, as shown in FIG. 2, receives an outer vertical edge of the display panel while the remaining channel is passed over the forward edge 32A of wall portion 32.

As best shown in FIGS. 2 and 4, the top surface of rib section 48 has a trough-like recess 51 into which there is received a correspondingly-shaped projection 52 which extends downwardly from the bottom surface of horizontal wall 26 along the side edge portion 26A. The interlocking relation between recess 51 and projection 52 occurs when modular units are horizontally adjoined. To provide raised support bases 10 for the modular constructional units, the height of a constructional unit is reduced by cutting along a desired parting line such as is indicated by reference numeral 10A in FIG. 2. A front kick panel 10B may be conveniently formed from the lower cut-off portion and glued or otherwise held in place. When the constructional units are horizontally adjoined, the outermost unit as one side is provided with a rectangular end panel 55. A channel stripping having recesses 43 and 44 on one side and projection 52 on the opposite side is used between modular constructional units in the first stack of a row since there is no horizontal adjoining unit to fill the gap between the top edge of one unit and the lower edge of a unit stacked thereabove. It is preferred to produce the modular units from molded polystyrene structural foam reinforced with glass fibers.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A combined storage bin and display assembly for decorative paper and the like, said assembly comprising vertically-stacked and horizontally-adjoined modular constructional units extending along an essentially straight-line path while forming storage bins and displays disposed at an angle with respect to said straight-line path, said modular constructional units each essentially including a horizontal wall section to define in a vertical stack of constructional units at least a bin ceiling or a bin floor, and a side wall section extending vertically from said horizontal wall section along two intersecting peripheral edge portions thereof, said side wall section defining a rear end wall and a longitudinal bin side wall having an outwardly-facing vertical display area extended beyond the forward edge of said horizontal wall section, said horizontal wall section and said side wall section each having support surfaces for either vertical stacking or horizontal adjoining of modular constructional units.

2. The assembly of claim 1 wherein said constructional units each includes spaced-apart support posts extending vertically along said side wall section.

3. The assembly of claim 2 wherein said support posts and said horizontal wall section include interlocking support surfaces.

4. The assembly of claim 1 further comprising a display panel including fastener means for removable support on said vertical display area.

5. The assembly of claim 1 wherein said display area includes a horizontal support rib extending outwardly along a substantial portion of the projected length thereof, said support rib having a display panel support surface, said assembly further including a display panel for support at one of the opposite sides thereof by a support rib of vertically-stacked modular constructional units.

6. The assembly of claim 1 wherein the support surfaces of said horizontal wall section include a trough to support at least a portion of a side wall section of each of at least two vertically-stacked modular construction units.

7. The assembly of claim 1 wherein the support surfaces of said horizontal wall section include a projected rib to support a portion of a horizontally-adjoining modular constructional unit.

8. The assembly of claim 1 wherein said support surfaces of said horizontal wall section include a projected rib extending along the ceiling surface at the side thereof opposite said longitudinal bin side wall.

9. The assembly of claim 1 wherein said support surfaces of said horizontal wall section include a trough extending along the outer peripheral portions of the bin floor at a location approximately above each of said rear end wall, said longitudinal bin side wall and the side opposite said longitudinal bin side wall.

10. The assembly of claim 1 wherein said horizontal wall section and said side wall section each has support surfaces to interlock for either vertical stacking or horizontal adjoining of modular constructional units.

11. A combined storage bin and display assembly for decorative paper and the like, said assembly comprising vertically-stacked and horizontally-adjoined modular constructional units extending along an essentially straight-line path while forming storage bins and displays disposed at an angle with respect to said straight-line path, said storage bins each having the shape of a square prism, said modular constructional units each ssentially including three mutually-adjoined bin side walls comprised of a horizontal side defining a bin floor in a vertical stack of constructional units, a first vertical side defining a bin rear end wall and a second vertical side defining a longitudinal bin side wall, said modular constructional units each further including an outwardly-facing vertical display wall projected from said longitudinal bin side wall beyond the forward edge of said bin floor, said longitudinal bin side wall and said display wall forming an entire side wall for a horizontally-adjacent storage bin, said bin floor and said longitudinal bin side wall having surfaces for vertical stacking and horizontal adjoining of modular constructional units at an angle along said straight-line path.

12. The assembly of claim 11 wherein said rear end wall and said longitudinal bin side wall extend downwardly from said bin floor.

13. The assembly of claim 11 further comprising at least one support post extending vertically along said rear end wall and along said longitudinal bin side wall.

14. The assembly of claim 11 further comprising a display panel including fastener means for removable support on said display wall.

15. The assembly of claim 11 wherein said display wall includes a horizontal support rib having a display panel support surface, said display wall having a horizontal recess along each of the upper and lower surfaces thereof, said assembly including a display panel to extend between said horizontal support rib and said recess.

16. The assembly of claim 11 wherein each display wall extends to said straight-line path whereby the projected length of the display wall from said bin floor defines the angular disposition of constructional units along said straight-line path.

17. The assembly of claim 11 wherein said bin floor and said longitudinal bin side wall have interlocking surfaces for vertical stacking and horizontal adjoining of modular constructional units.

* * * * *